US006237499B1

(12) United States Patent
McKoy

(10) Patent No.: US 6,237,499 B1
(45) **Date of Patent: *May 29, 2001**

(54) WATERCRAFT AMUSEMENT RIDE

(76) Inventor: Errol W. McKoy, 6403 Clubhouse Cir., Dallas, TX (US) 75240

( * ) Notice: Subject to any disclaimer, the term of this patent is extended or adjusted under 35 U.S.C. 154(b) by 0 days.

This patent is subject to a terminal disclaimer.

(21) Appl. No.: 09/281,740

(22) Filed: Mar. 30, 1999

Related U.S. Application Data

(63) Continuation-in-part of application No. 09/050,810, filed on Mar. 30, 1998, now Pat. No. 5,860,364, which is a continuation-in-part of application No. 08/661,365, filed on Jun. 11, 1996, now Pat. No. 5,732,635.

(51) Int. Cl.[7] ..... A63G 21/00

(52) U.S. Cl. ..... 104/59; 104/70; 104/292

(58) Field of Search ..... 104/23.1, 23.2, 104/59, 70, 71, 72, 73, 281, 282, 290, 292

(56) References Cited

U.S. PATENT DOCUMENTS

| | | | | |
|---|---|---|---|---|
| 357,790 | | 2/1887 | Schaefer . | |
| 536,357 | * | 3/1895 | Palacio | 104/139 |
| 536,441 | | 3/1895 | Morris . | |
| 849,970 | | 4/1907 | Boyton . | |
| 1,358,305 | * | 11/1920 | Feltman | 104/59 |
| 1,379,939 | * | 11/1921 | Unger | 104/60 |
| 1,448,306 | * | 3/1923 | Lezert | 104/73 |
| 3,003,430 | * | 10/1961 | Hamel | 104/72 |
| 3,404,635 | * | 10/1968 | Bacon et al. | 104/73 |
| 3,577,928 | * | 5/1971 | Victorri | 104/292 |
| 3,690,265 | | 9/1972 | Horibata | 104/70 |
| 3,830,161 | * | 8/1974 | Bacon | 104/70 |
| 3,834,316 | * | 9/1974 | Hennings | 104/292 |
| 3,838,657 | * | 10/1974 | Fleming | 104/183 |
| 3,841,227 | * | 10/1974 | Fink | 104/290 |
| 3,853,067 | | 12/1974 | Bacon | 104/70 |
| 3,854,415 | * | 12/1974 | Lamberet | 104/173.1 |
| 3,930,450 | | 1/1976 | Symons | 104/73 |
| 4,149,469 | | 4/1979 | Bigler | 104/73 |
| 4,299,171 | | 11/1981 | Larson | 104/70 |
| 4,337,704 | | 7/1982 | Becker et al. | 104/70 |
| 4,392,434 | | 7/1983 | Durwald et al. | 104/70 |
| 4,725,398 | * | 2/1988 | Ruckey et al. | 104/183 |
| 4,823,705 | * | 4/1989 | Fukuda | 104/140 |
| 4,895,079 | * | 1/1990 | Beatty | 104/183 |
| 5,011,134 | | 4/1991 | Langford | 272/56.5 R |
| 5,215,016 | * | 6/1993 | Futami | 104/71 |
| 5,234,285 | * | 8/1993 | Cameron | 104/173.1 |
| 5,299,964 | | 4/1994 | Hopkins | 114/346 |
| 5,860,364 | * | 1/1999 | McKoy | 104/292 |

FOREIGN PATENT DOCUMENTS

| | | | | |
|---|---|---|---|---|
| 192742 | * | 11/1937 | (CH) | 104/173 |
| 280336 | * | 8/1988 | (EP) | 104/183 |

* cited by examiner

*Primary Examiner*—Mark T. Le
(74) *Attorney, Agent, or Firm*—Dennis T. Griggs

(57) ABSTRACT

Passenger boats are mounted on an undercarriage assembly that includes rail-mounted centering wheels. The passenger boats are accelerated by linear induction drive motors mounted on a guide rail structure. Thrust is applied to the racing boats by magnetically conductive reaction plates that are attached to the undercarriage assembly and are movable through linear flux slots formed in the induction stators of the linear induction motors. The submerged guide track structure is arranged in various closed loop courses, including "Figure-Eight," an hour-glass, serpentine and oval patterns, as well as parallel guide track structures that extend between a launch station and a return station. A dual "Figure-Eight" watercourse includes a simulated jump ramp and an underground tunnel arrangement. In the continuous loop guide structure, two or more boats are launched and separation is maintained by a safety block arrangement.

17 Claims, 8 Drawing Sheets

WATERCRAFT AMUSEMENT RIDE

This application is a continuation-in-part of 09/050,810 Mar. 30, 1998 now U.S. Pat. No. 5,860,364 which is a continuation-in-part of 08/661,365 Jun. 11, 1996 now U.S. Pat. No. 5,732,635.

BACKGROUND OF THE INVENTION

This invention relates generally to amusement watercraft, and in particular to a passenger boat ride in which passenger boats are propelled along a submerged guide channel from a ground level launch or from an inclined launch across or around a watercourse.

Amusement parks and theme parks such as Six Flags Over Texas, Opryland U.S.A., Cedar Point, Carowinds, Busch Gardens, Geauga Lake, Elitch Gardens and many others feature various watercraft rides that are guided safely through natural and man-made waterways. Some watercraft rides that are currently popular include a floating gardens ride, a river rapids ride, a log flume ride and a mill chute ride.

In a typical watercraft ride, a passenger boat is guided along a water channel from a passenger loading station to one or more intermediate stations and back to the passenger loading station. Such boats are usually propelled in part by water currents, gravity or passenger manpower, although some are propelled by motor-driven chains. Generally, variations such as music, sound effects, lighting effects, stage props and costumed characters enhance the entertainment value of the ride.

Some dominant concerns in the operation of such rides is the creation of a sense of fun and excitement while maintaining passenger safety, reliable equipment operation and expedited handling of passengers during loading and off-loading.

DESCRIPTION OF THE PRIOR ART

Conventional watercraft amusement rides are described in the following patents:

| U.S. Pat. No. | Inventor | Title of Invention |
|---|---|---|
| 357,790 | Schaefer | Marine Boat Slide |
| 849,970 | Boyton | Amusement Device |
| 3,404,635 | Bacon et al | Boat Amusement Ride |
| 3,830,161 | Bacon | Flume Boat Ride with a Double Downchute |
| 4,392,434 | Durwald et al | Turbulent Waterway |
| 3,853,067 | Bacon | Boat Amusement Ride with a Spillway |
| 4,299,171 | Larson | Demountable Flume Amusement Ride |
| 4,337,704 | Becker | Turbulent-Water Way |
| 4,149,469 | Bigler | Log Braking and Stabilizing System for Log Flume Ride |
| 5,011,134 | Langford | Waterslide with Uphill Run and Flotation Device Therefor |
| 3,690,265 | Horibata | Aquatic Sled and Shooting Apparatus Thereof |
| 5,299,964 | Hopkins | Amusement Raft Ride |
| 4,836,521 | Barber | Whirlpool Amusement Ride |
| 5,069,443 | Shiratori | Water Slider Lane |
| 5,282,772 | Ninomiya | Simulator for Shooting Down the Rapids |

-continued

| U.S. Pat. No. | Inventor | Title of Invention |
|---|---|---|
| 4,391,201 | Bailey | Aquatic Toboggan Slide |
| 4,543,886 | Spieldiener | Amusement Ride Including a Rotating Loading Terminal |
| 3,923,301 | Myers | Amusement Water Slide and Method |
| 3,930,450 | Symons | Boat Ride for Amusement Park |
| 5,213,547 | Lochtfeld | Method and Apparatus for Improved Water Rides by Water Injection and Flume Design |
| 4,516,943 | Spieldiener | Amusement Ride Raft |

These patents disclose various watercraft amusement rides in which a passenger boat is propelled through a flume or guided down an inclined launch, and then recovered. For example, U.S. Pat. No. 849,970 discloses an inclined launch in which a pair of passenger boats are winched up dual tracks by sprocket-driven chains, are reversed on a turntable and then permitted to descend the launch by the force of gravity along the inclined tracks into a splash lake. The boats are guided by wheels along the guide tracks during descent.

U.S. Pat. No. 3,830,161 discloses a flume boat ride having dual launch chutes that guide amusement boats through a shallow body of water. A similar boat ride is shown in U.S. Pat. No. 3,404,635 in which a pair of passenger boats are guided from an elevated passenger loading station along dual tracks into a waterway.

U.S. Pat. No. 4,392,434 discloses an amusement boat ride in which a passenger boat is pulled by a chain drive to a launch station above a turbulent waterway. The passenger boat is then released from the chain drive and travels by gravity on guide wheels that roll along a guide track.

Conventional watercraft rides as exemplified by the patents discussed above broadly disclose the concept of guiding one or more amusement boats from an elevated launch into a waterway.

The operators of amusement parks are constantly striving to provide safe, yet thrilling and entertaining boat rides. Accordingly, there is a continuing interest in providing novel watercraft rides that offer passengers a memorable and exciting ride experience under closely controlled, safe operating conditions.

BRIEF SUMMARY OF THE INVENTION

The amusement boat ride according to a first embodiment of the present invention is a simulated boat race in which a pair of racing boats compete in forward and return heats. Novel combinations of sudden acceleration/deceleration, high velocity travel, reversal of movement, exposure to lighting effects, sound effects, water spray and group competition provide a sense of excitement and fun. The passengers of each boat are subjected to high launch velocity, high speed hydroplaning across a splash lake, and giant water spray rooster tails that, in the spirit of good fun, spray onto passengers of the competing boat as well as onto nearby spectators. The passenger boats are propelled along parallel guide channels from one launch station to the other by linear induction motor that are structurally integrated with the passenger boat undercarriage and the submerged guide channels.

According to an alternative amusement ride of the present invention, a pair of passenger boats are launched from a first pair of inclined launch ramps and are propelled by linear induction motors along guide rails into a shallow splash lake. The passenger boats are then accelerated along the parallel guide channels by the linear induction motors so that the boats hydroplane across the splash lake. The linear induction motors propel the passenger boats partially up a second pair of inclined launch ramps on the opposite end of the splash lake to a predetermined return launch elevation.

Upon reaching the return launch elevation, the direction of thrusting force is reversed and the passenger boats are propelled rapidly down the inclined launch ramps with the passengers facing away from the direction of return travel. The passenger boats are then propelled along the guide channels across the shallow splash lake at hydroplaning speed, followed by coasting at a reduced speed to the passenger loading station.

In each embodiment, the passenger boats are stabilized by centering wheels and guide rollers that travel along submerged rails that run in parallel along the guide channels. In one arrangement, the linear induction motors include stators that are mounted laterally offset from the guide rails and in tandem relation with each other along opposite sides of each guide channel. In another arrangement, the linear induction motor stators are mounted on the rail support structure and vertically offset and centered beneath the undercarriage assembly in tandem relation with each other along the rail guide structure. In this arrangement, a reaction plate is attached to the undercarriage assembly and projects vertically into the stator flux slots.

Each linear induction motor includes a stator having a linear magnetic flux slot for receiving a reaction plate. The passenger boat is attached to an undercarriage assembly which is movably coupled to the guide rails by the centering wheels and rollers. A pair of reaction plates are attached to the undercarriage assembly and project laterally into the stator flux slots. Each stator, when energized with AC electrical current, produces electromagnetic flux waves which travel longitudinally through each flux slot. The electromagnetic forces imposed on the reaction plates produce linear thrust which drives the undercarriage assembly and passenger boat along the guide rails.

BRIEF DESCRIPTION OF THE DRAWINGS

The accompanying drawing is incorporated into and forms a part of the specification to illustrate the preferred embodiments of the present invention. Throughout the drawing, like reference numerals designate corresponding elements. This drawing, together with the description, serves to explain the principles of the invention and is only for the purpose of illustrating. exemplary embodiments showing how the invention can best be made and used. The drawing should not be construed as limiting the invention to the illustrated and described embodiments. Various advantages and features of the invention will be understood from the following detailed description taken in connection with the appended claims and with reference to the attached drawing in which:

DETAILED DESCRIPTION OF THE INVENTION

Figure 1:
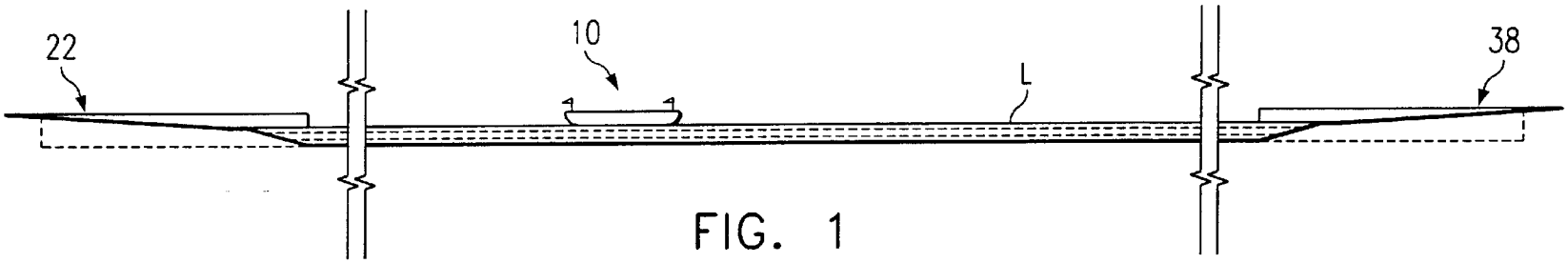
FIG. 1 is a simplified side elevational view of a simulated racing boat ride having launch stations on opposite ends of a splash lake.

Preferred embodiments of the present invention are described herein by referring to various examples of how the invention can be made and used. Like reference numerals are used throughout the description and several views of the drawing to indicate like or corresponding parts.

In the description which follows, like parts are marked through the specification and drawings with the same reference numerals, respectively. The drawing figures are not necessarily to scale, and the proportions of certain parts have been exaggerated for sake of clarity.

Referring now to FIGS. 1–4, a simulated boat race is conducted in first and second heats in which a pair of racing boats 10, 12 are propelled by first and second pairs of linear induction motors 14, 16 and 18, 20, respectively, from a forward launch station 22 at a hydroplaning speed, for example 40 m.p.h., along parallel guide channels 24, 26 across a shallow splash lake L to a first heat finish line 28. Large (twenty feet high) water spray rooster tails follow the passenger boats across the lake. The winning time of the first heat is announced and displayed on an electronic score board. The racing boats 10, 12 are then propelled at a coasting speed by a second set of linear induction motors 20, 32 and 34, 36 to a return launch station 38 on the opposite end of the splash lake.

The racing boats are held steady at the return launch station 38 during a second heat countdown, and then are suddenly accelerated by the second set of linear induction motors along the guide channels 24, 26 into the shallow splash lake L in the reverse (return) direction to the second heat finish line 40. The winning time of the second heat is then announced and displayed. The passengers remain facing the return launch station (opposite to the direction of return travel) during the return heat as the racing boats hydroplane across the splash lake, thus permitting the passengers to watch closely as both boats generate the giant water spray rooster tails.

Figure 3:
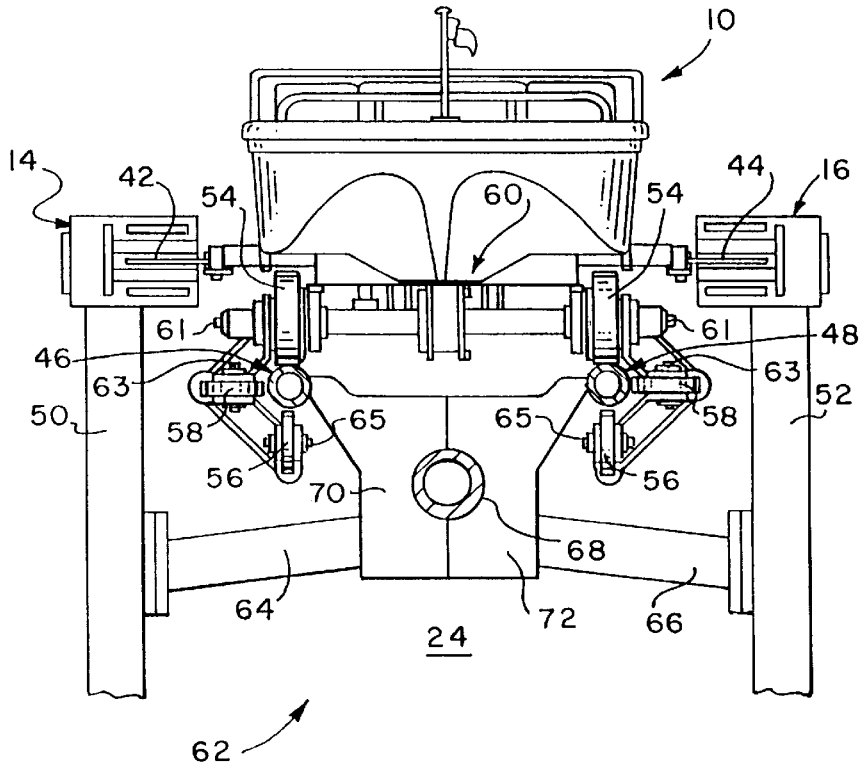
FIG. 3 is a front elevational view of a racing boat mounted on guide rails and magnetically coupled to a pair of linear induction motors.
Figure 4:
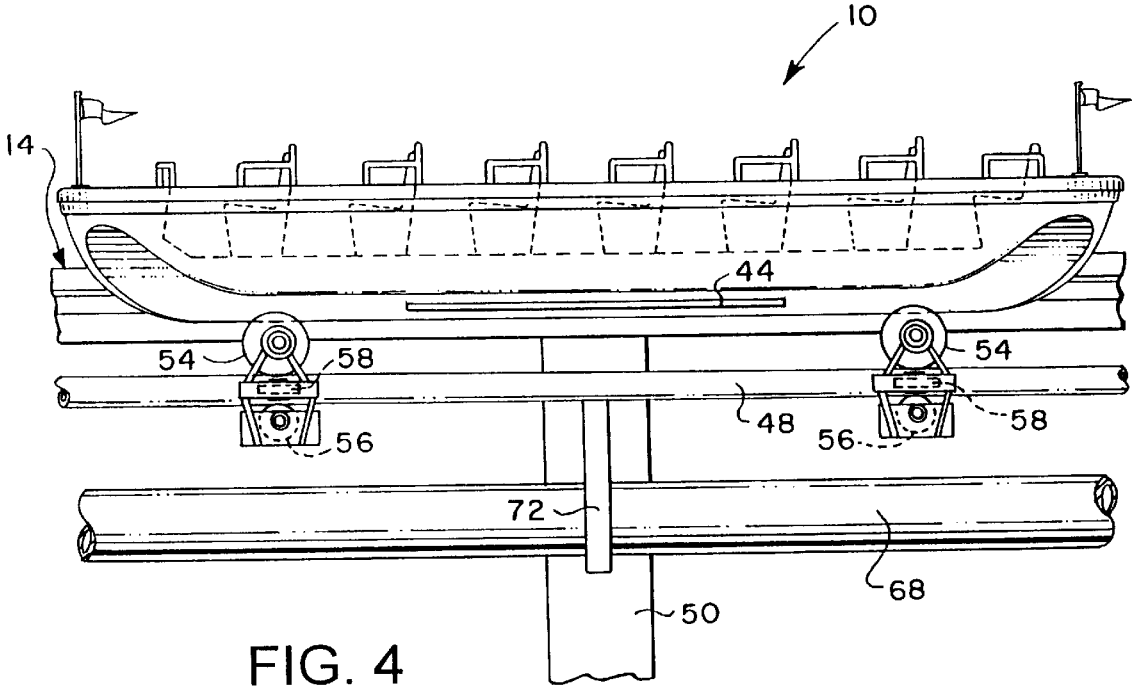
FIG. 4 is a side elevational view thereof.
Figure 6:
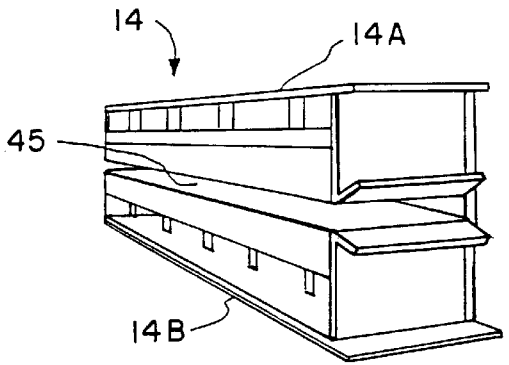
FIG. 6 is a side perspective view of a linear induction motor.
Figure 8:
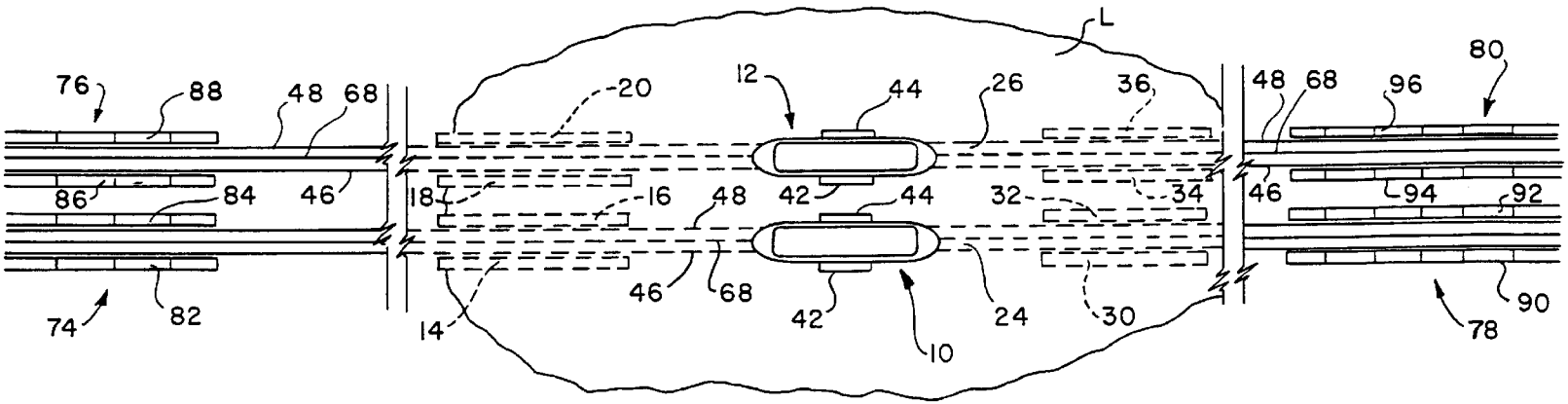
FIG. 8 is a top plan view thereof.

The racing boats 10, 12 are propelled along the parallel guide channels 24, 26 by the linear induction motors 14, 16 that are magnetically coupled to each racing boat, respectively, by laterally projecting reaction plates or fins 42, 44 (FIG. 3, FIG. 4 and FIG. 8). Referring now to FIG. 3 and FIG. 6, each group ○ linear induction motors, for example group 14, include forty linear induction motor units mounted in tandem relation. The linear induction motor construction shown in FIG. 6 is typical, with the linear induction motor 14 including a pair of linear stators 14A, 14B separated by a narrow, linear flux slot 45. Each stator includes slotted, laminated steel core members which are wound with three-phase winding coils that are energized with alternating current from a three-phase source.

When the magnetically conductive reaction plates are present in the flux slots, currents are induced in the reaction plates and produce a reaction flux wave of the same magnetic polarity as the stator flux wave. The reaction wave forces the reaction plate in the same direction as the stator flux wave is traveling. The interaction of the stator and reaction plate flux waves produce forces in the longitudinal direction and in the normal direction. The longitudinal thrust force moves the reaction plate in direction of the traveling flux wave. The normal force levitates the reaction plate. As a result, the reaction plate achieves equilibrium velocity when the thrust exerted on it by the traveling flux wave is balanced by the restraining drag load imposed by the undercarriage and the passenger boat.

The linear induction motors maintain positive control of the speed and relative positions of the racing boats during acceleration and braking. The dual launch stations 22, 38 on opposite ends of the shallow splash lake L permit the passengers to experience rapid acceleration and hydroplaning across the splash lake at a high speed to the forward heat finish line 28, followed by hydroplaning across the splash lake at a high speed in the reverse (return) direction to the return heat finish line 40, with the boats being guided along parallel rails 46, 48 and 50, 52 during both heats.

Prior to the start of the first heat, the passengers are loaded onto the racing boats 10, 12 from a ground level staging platform P. After passenger loading has been completed, the racing boats 10, 12 are held in launch pens 22A, 22B at the forward launch station 22 during the forward heat countdown. Upon launch, the racing boats are accelerated along the guide channels 24, 26 by the linear induction motors 14, 16 and 18, 20. As the racing boats exit the forward launch, they hydroplane across the shallow lake L at a high speed, for example 40 miles per hour, thus creating giant water spray rooster tails as they approach the forward heat finish line 28.

After the racing boats 10, 12 cross the forward heat finish line, the linear induction motors 30, 32 and 34, 36 continue to drive the racing boats at a reduced (coasting) speed, for example 5 m.p.h., along the drive channels to the return launch station 38 on the opposite end of the splash lake. The racing boats are held in launch pens 38A, 38B during a second heat countdown and then are accelerated rapidly along the guide channels while the passengers remain facing the return launch station so that they can observe the water spray rooster tails. The racing boats 10, 12 hydroplane across the shallow lake at a high speed, for example 40 mph, to the return heat finish line 40. The racing boats are then propelled by the linear induction motors 14, 16 and 18, 20 at a coasting speed, for example 5 m.p.h., to the staging platform P where the passengers are off-loaded and new passengers are admitted for the next race.

Figure 2:
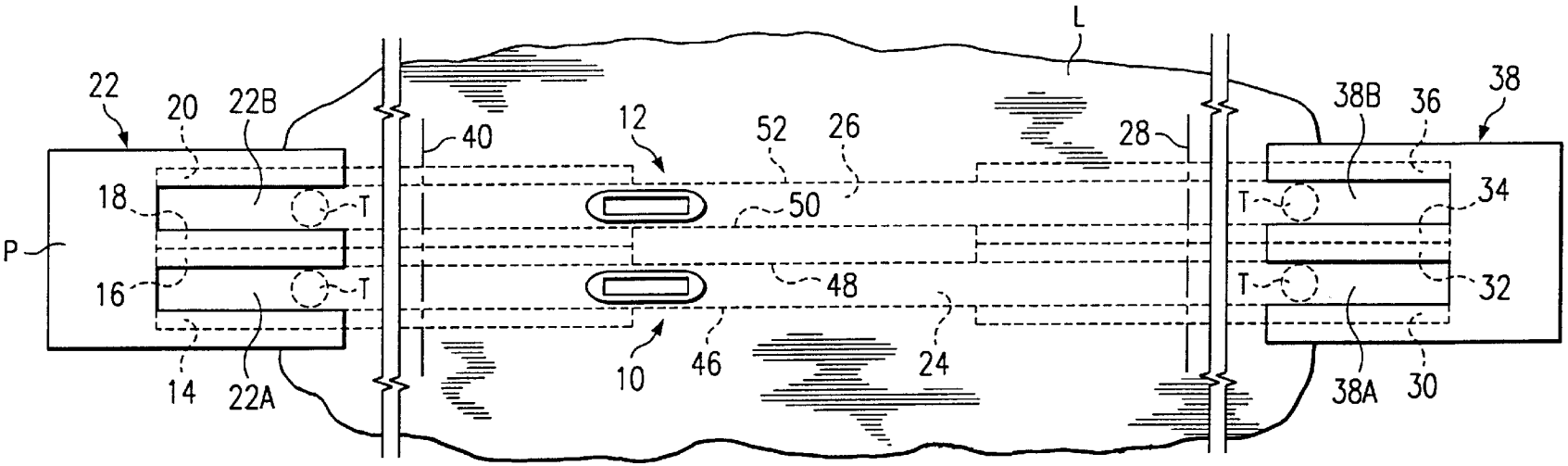
FIG. 2 is a top plan elevational view thereof.

Hydraulically actuated turntables T are submerged in the launch pens 22A, 22B and 38A, 38B as shown in FIG. 2. When actuated, the turntables T elevate the passenger boats above the deck surfaces of the loading platforms 22, 38 and turn the passenger boats through 180 degrees so that the passengers are facing in the direction of travel during the return heat.

Preferably, each heat of the simulated boat race is accompanied by giant voice (public address) messages announcing departure, countdown, timing lights that indicate various stages during the countdown and loud warning signals prior to launch. Synchronized sound effects and flashing light effects accentuate the acceleration of the launch. Compressed steam is released at each launch station as the racing boats initially accelerate across the splash lake. An electronic scoreboard flashes the winning time as the racing boats are guided under linear induction motor control to each launch station. The special effects are repeated as the racing boats are propelled from the return launch station to the second heat finish line 40.

Referring now to FIG. 3 and FIG. 4, the linear induction motors 14, 16 are mounted on support posts 50, 52 in parallel alignment with the guide rails 46, 48. High velocity movement of each passenger boat is stabilized laterally and vertically by multiple sets of centering guide wheels 54, 56 and 58 (FIG. 4) that are mounted on an undercarriage 60 beneath each racing boat. The guide wheels are mounted for rotation on axles 61, 63 and 65, respectively.

Lateral movement of each racing boat is opposed by the centering wheels 58 and vertical movement is opposed by the centering wheels 54, 56. As shown in FIG. 3, the centering wheels ride on the tubular rails 46, 48. The guide wheels are captured for rolling movement along the guide rails thus maintaining the racing boats centered horizontally within their respective guide channels 24, 26 and vertically in alignment with the linear induction motors.

The guide rails 46, 48 form continuous runways along the guide channels 24, 26. The guide wheels 54 are mounted on the main axle 61 for rolling movement along the guide rails 46, 48 with lateral movement being opposed by the centering wheels 58. Downward (bottoming) movement of each passenger boat is opposed by rolling engagement of the upper guide wheels 54 against the top surface of the guide rails. Upward (pitching) movement of each passenger boat is opposed by engagement of the lower guide wheels 56 against the underside of the guide rails 46, 48.

Referring again to FIG. 3 and FIG. 4, a guide channel structure 62 is formed by a tubular weldment which is submerged within the splash lake L. The guide rails 46, 48 are formed by continuous tubular beams that are elevated from the lake bed by struts 64, 66, respectively. The struts and guide rails are connected to a central support beam 68 by gusset plate weldments 70, 72. Opposite ends of the struts are welded to the support posts 50, 52.

Figure 5:
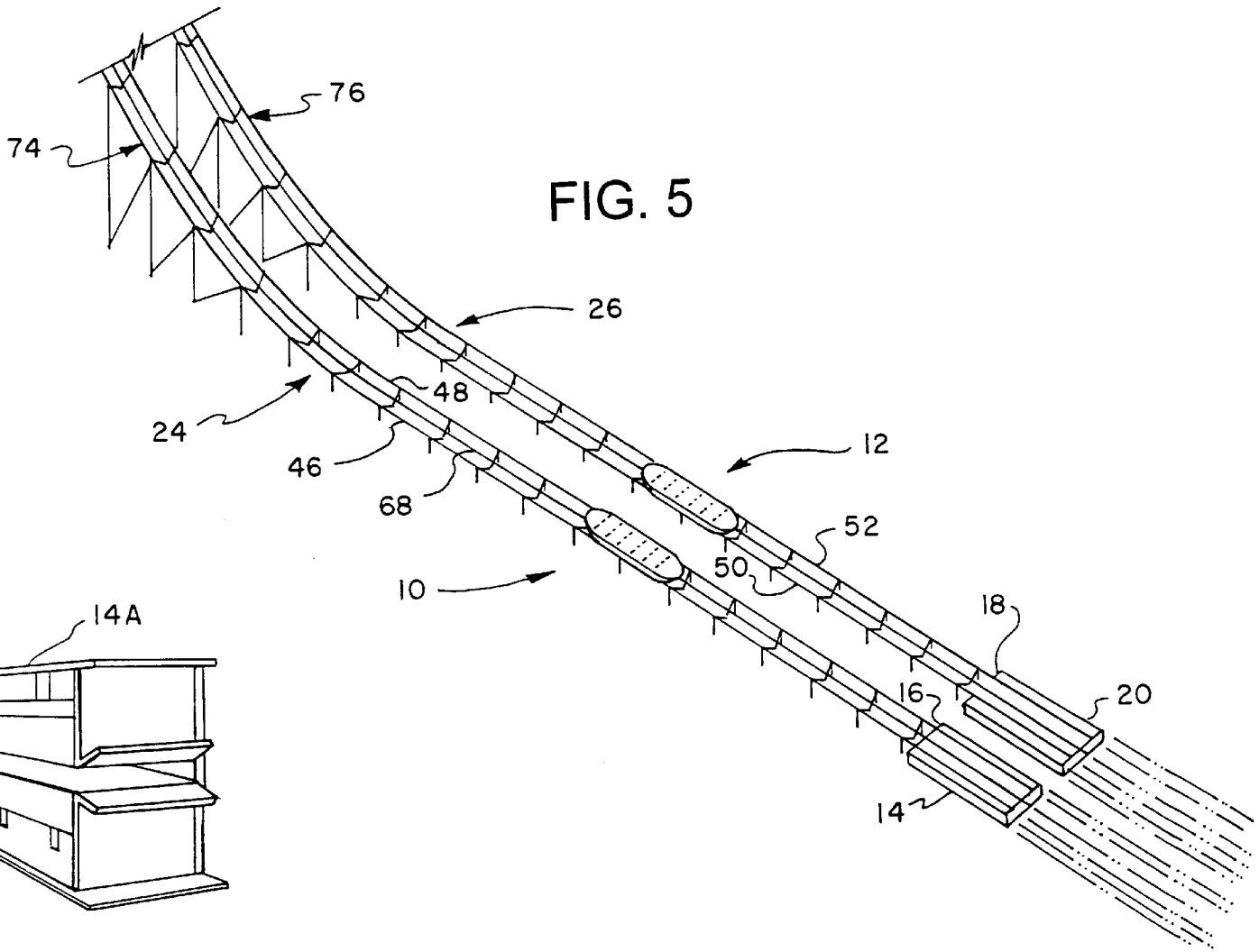
FIG. 5 is a simplified perspective view of an inclined launch ramp.
Figure 7:
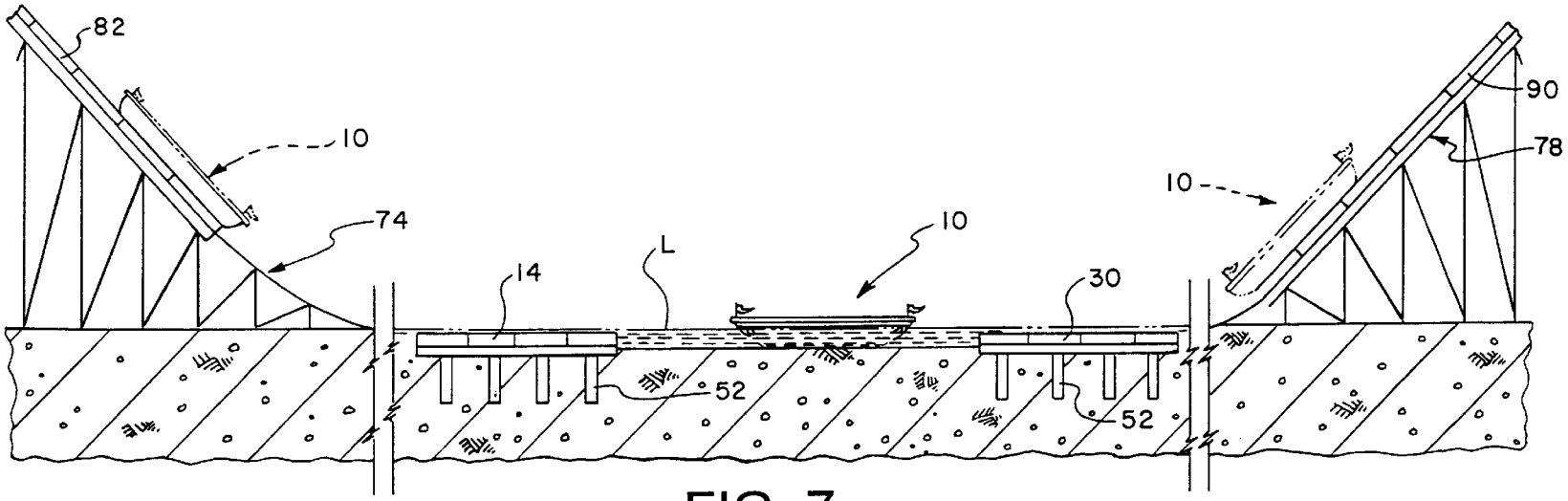
FIG. 7 is a side elevational view showing an amusement boat ride in which a pair of passenger boats are driven by linear induction motors through a splash lake situated between a pair of inclined launch ramps.

Referring now to FIG. 5, FIG. 7 and FIG. 8, an alternative amusement ride of the present invention includes a first pair of inclined launch ramps 74, 76 located adjacent one end of the splash lake L. A second pair of inclined launch ramps 78, 80 are located on the opposite end of the splash lake L in alignment with the guide channels 24, 26, respectively. Groups of linear induction motors 14, 16; 18, 20; 30, 32; and 34, 36 are submerged within the splash lake in the same manner as described with reference to the FIG. 2 amusement ride embodiment.

In this embodiment, aligned groups of linear induction motors 82, 84; 86, 88; 90, 92; and 94, 96 are installed laterally adjacent the guide rails on the scaffolding which supports the inclined ramps. According to this amusement ride arrangement, the passenger boats are propelled by the submerged linear induction motors from the splash lake L upwardly along the inclined ramp 74. The momentum of the passenger boats carry them into magnetic coupling alignment with the elevated linear induction motors 82, 84, 86 and 88. The reaction plates 42,44 are coupled magnetically with the traveling linear magnetic flux wave, thus propelling the passenger boats up the inclined ramp 74 to a predetermined launch elevation, for example a height of 70 feet.

Upon reaching the launch elevation, the direction of thrust is reversed and the elevated linear induction motors propel the passenger boats rapidly down the inclined launch ramp 74 into the shallow splash lake. The passenger boats 10, 12 are then accelerated along the parallel guide channels 24, 26 by the submerged linear induction motors so that the passenger boats hydroplane at a high speed, for example 40 mph, across the splash lake toward the inclined ramps 78,80. As the passenger boats enter the flux zone of the second group of submerged linear induction motors, they are accelerated again and the momentum carries them partially up the inclined ramps 78, 80 until the radially projecting reaction plates 42, 44 become magnetically coupled with the elevated linear induction motors, which propel the passenger boats up the inclined launch ramps to a predetermined return launch elevation.

Upon reaching the return launch elevation, the direction of thrusting movement is reversed and the passenger boats are propelled rapidly down the inclined return ramps 78, 80 with the passengers facing away from the direction of return travel. The reaction plates 42,44 once again become magnetically coupled to the submerged linear induction motors 30, 32 and 34, 36, and the passenger boats are quickly accelerated to hydroplaning speed. The passenger boats 10, 12 coast at hydroplaning speed until their laterally projecting reaction plates become magnetically coupled with the submerged linear induction motors 14,16 and 18,20, whereupon their coasting speed is reduced for safe entry into the passenger loading station.

Figure 9:
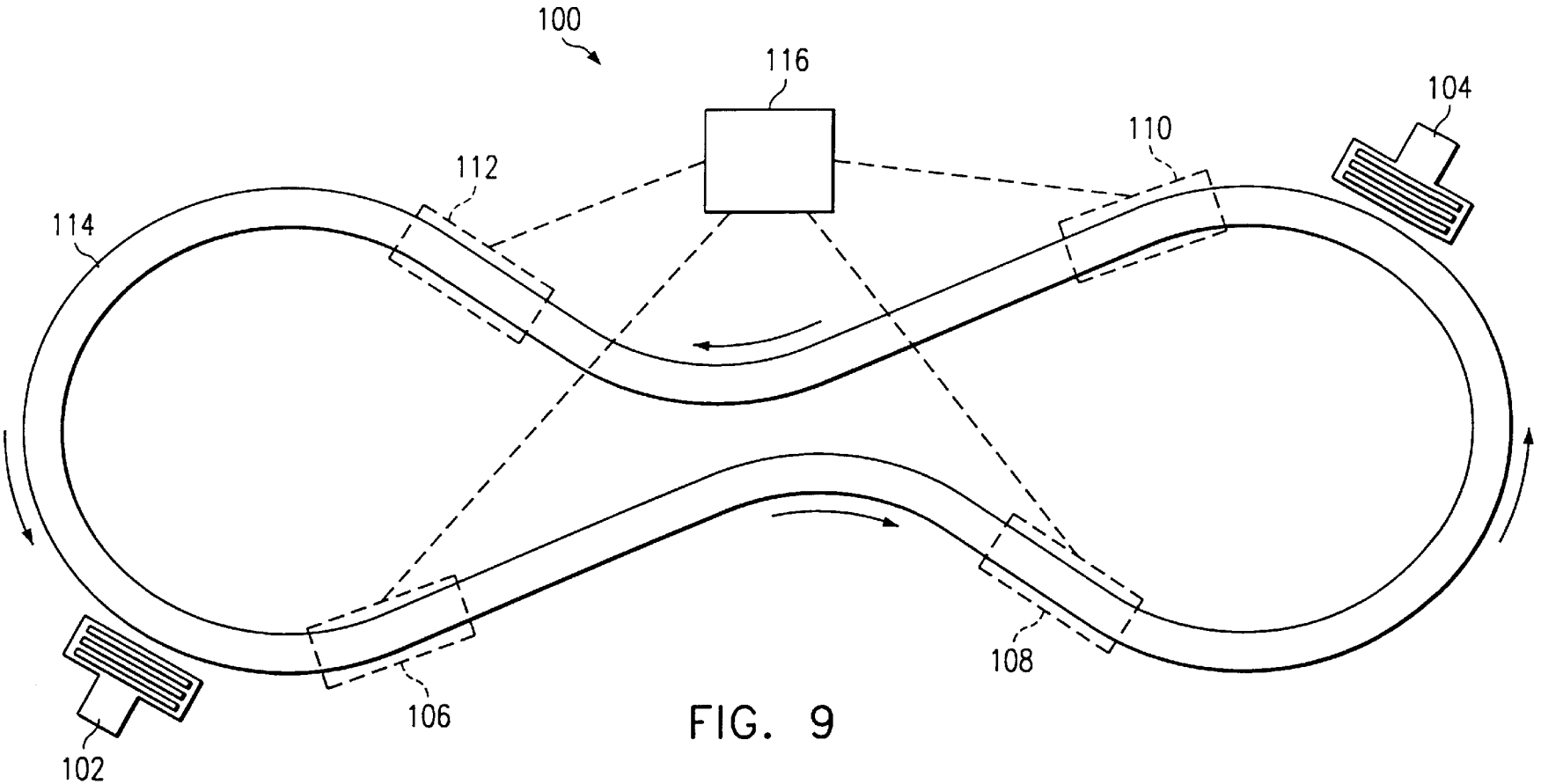
FIG. 9 is a top plan view showing an amusement boat ride in which a pair of passenger boats are propelled across a splash lake along a continuous loop, Figure-8 guide channel situated between a pair of launch ramps.

Referring now to FIG. 9, a continuous loop guide structure 100, arranged in the general form of an hour glass pattern, is submerged in the watercourse and provides a continuous guide channel from a first passenger loading station 102 to a second passenger loading station 104. Multiple linear induction motor groups 106, 108, 110 and 112 each include a stator component mounted on the guide structure 114 for propelling one or more passenger boats through the watercourse. Preferably, the guide channel structure a dual guide rail support arrangement shown in FIG. 3 and FIG. 4, and the passenger boats are supported for rolling movement along the guide rails on and undercarriage assembly.

When multiple passenger boats are launched, a safety release system 116 coordinates the release and speed of each passenger boat under microprocessor and limit switch control thereby maintaining a safe operating separation between the passenger boats at all times.

Figure 11:
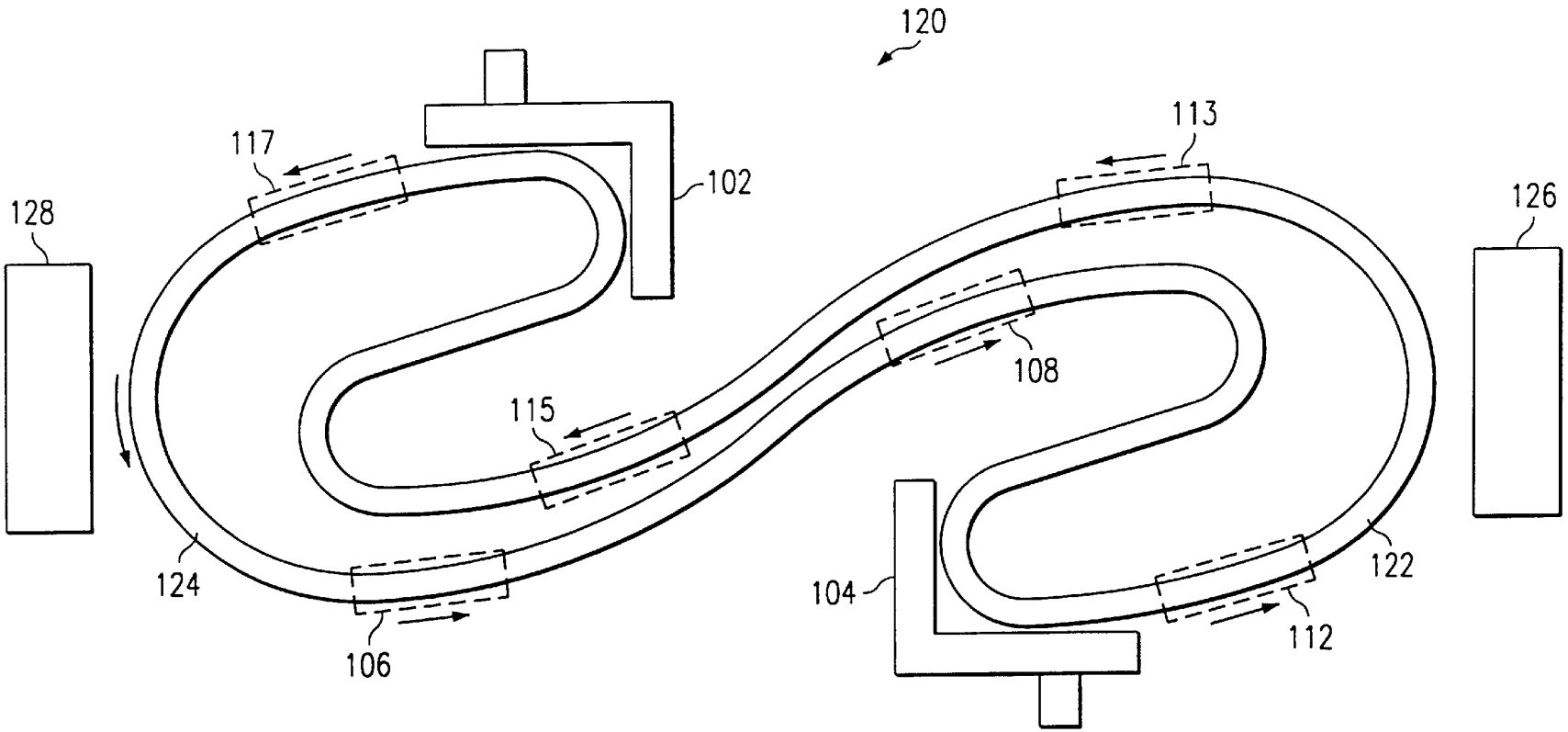
FIG. 11 is a top plan view of a continuous loop, submerged guide channel which extends in a Figure-S pattern between a pair of launch stations.

In the continuous loop embodiment, the guide structure can assume various configurations such as the dual "Figure 8" arrangement 118 and the serpentine pattern 120 shown in FIG. 11. Other closed loop arrangements, including oval and circular patterns, can be used to good advantage.

Referring again to FIG. 9, passengers are transported through a watercourse 100 comprising a guide structure 114 submerged in the watercourse and arranged in an hour-glass pattern. Passenger boats are launched from loading platforms 102,104 at opposite ends of the guide channel structure. The safety release system 116 coordinates the release and operating speed of the boats so that they close toward each other and in passing at the midpoint of the hour-glass pattern, project water spray onto the other boat as they recede from each other.

Referring now to FIG. 11, passengers are transported on two or more passenger boats through a watercourse including a serpentine guide structure 120 submerged in the watercourse and arranged in closed loop through the watercourse including oval loop portions 122,124 that are banked or inclined with respect to spectator stands 126,128. The passenger boats are banked around the inclined loops and spray the spectator stands with water as each passenger boat transitions through the turn.

Referring again to FIG. 2, passengers are transported on first and second passenger boats 10,12 along a watercourse including first and second guide structures 24,26 submerged in the watercourse and extending from the first launch station 22 to the second launch station 38. The boats are launched from opposite ends of the watercourse and the speed of each boat is controlled so that they approach closely to each other substantially at the midpoint of the watercourse, and project water spray onto the other boat as the passenger boats recede from each other.

Figure 10:
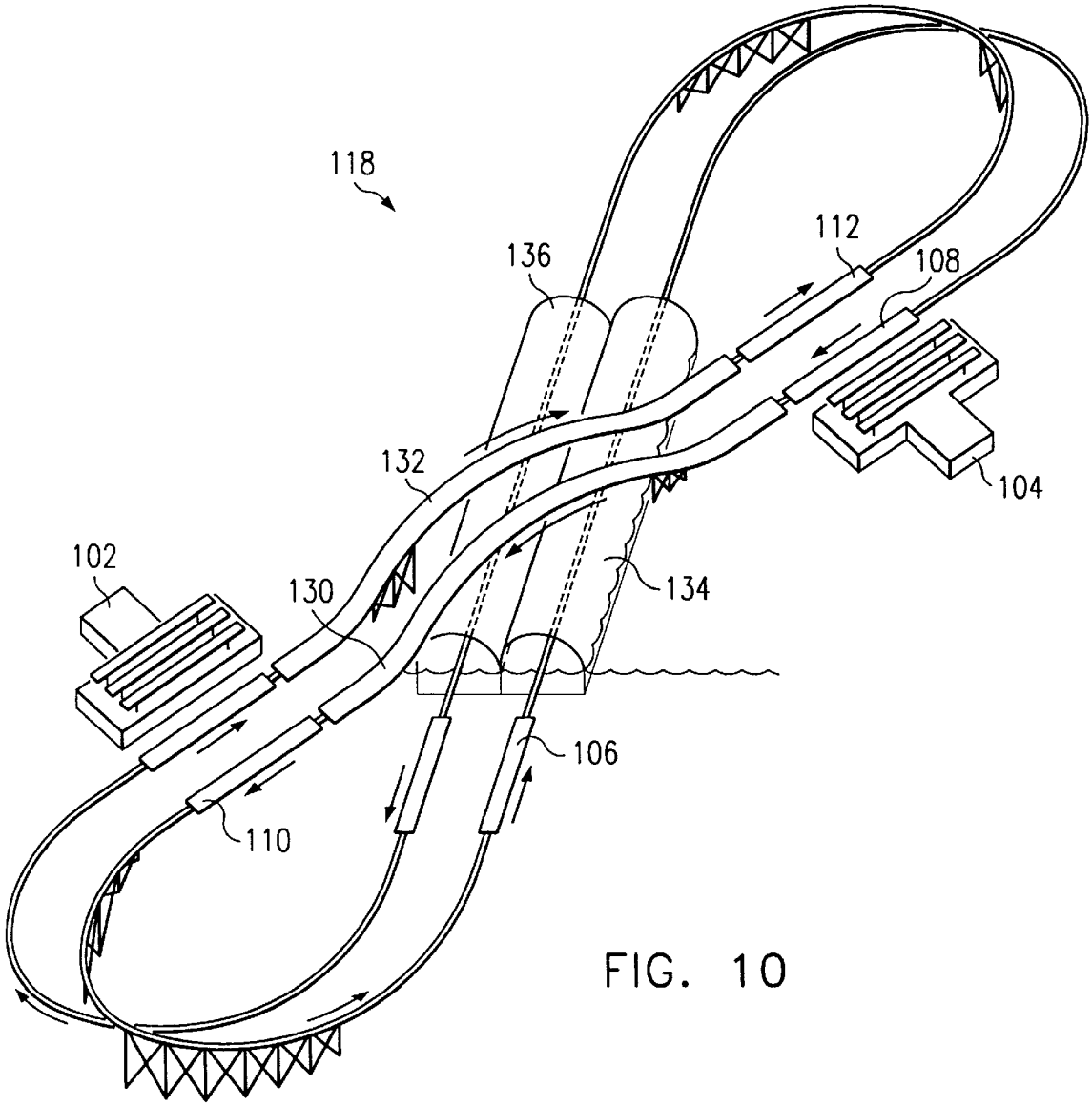
FIG. 10 is a perspective view showing an amusement boat ride in which a pair of passenger boats are propelled across a splash lake along submerged and elevated guide channels between a pair of launch ramps.

Referring now to FIG. 10, passengers are transported through a watercourse including a guide structure 118 formed in a dual "Figure Eight" pattern submerged in the watercourse and extending in a closed loop through the watercourse. The passenger boats are guided over elevated jump ramps 120, 132 along one portion of the watercourse, and on return, the passenger boats are guided beneath the jump ramps through underground tunnel structures 134,136.

Figure 12:
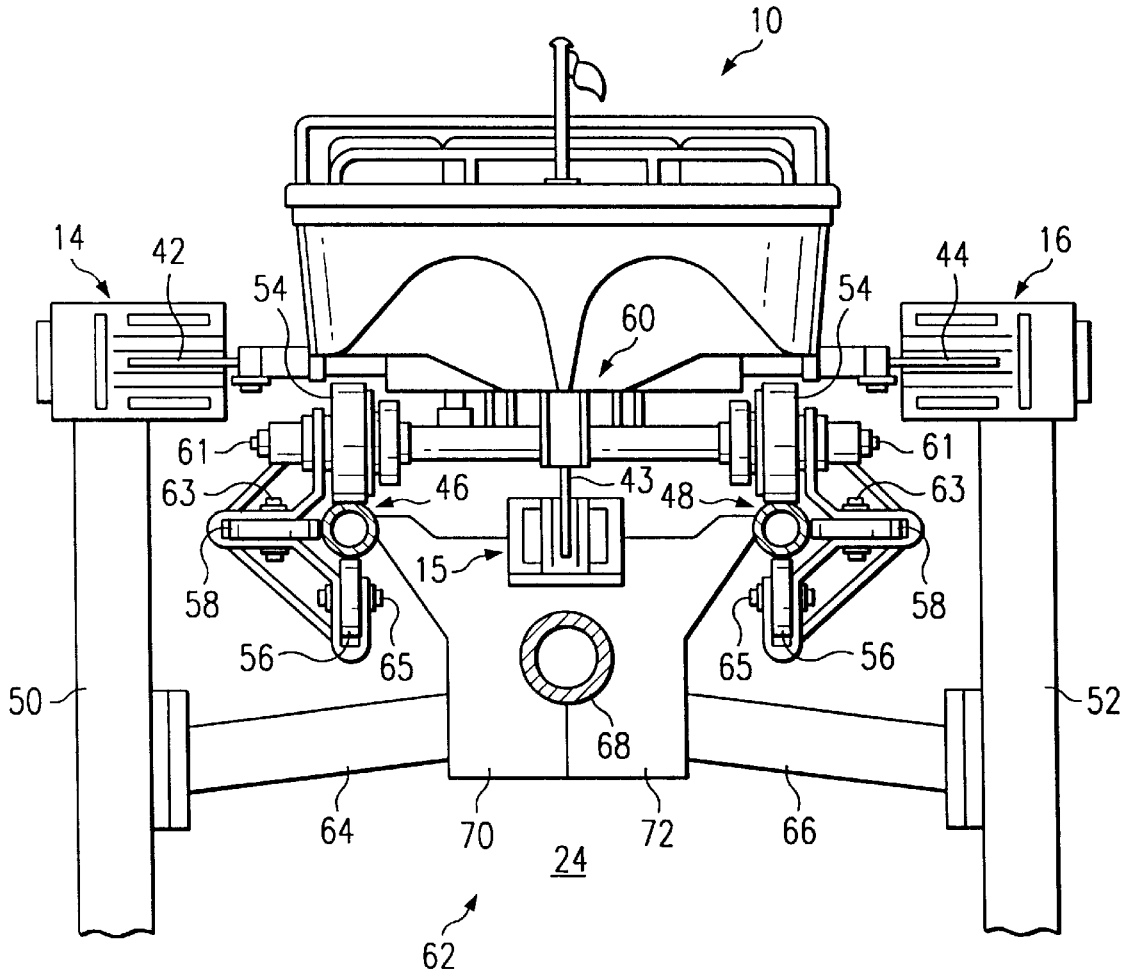
FIG. 12 is a view similar to FIG. 3 which illustrates a passenger boat mounted on guide rails and coupled to the flux slot of a linear induction stator by a downwardly projecting reaction plate.

Referring now to FIG. 12, a magnetically responsive reaction plate 43 is attached to the undercarriage 60 which supports the passenger boat. In this embodiment, the reaction plate 43 projects beneath the passenger boat for longitudinal travel through the flux slot of a stator 15 which is mounted on the submerged guide structure 62. The reaction plate 43 is responsive to magnetic flux produced by the induction stator 15 for propelling the passenger boat along the guide structure.

Typical construction specifications for the simulated boat race and passenger boat climb amusement rides are given in TABLE 1 and TABLE 2 below.

TABLE 1

| SIMULATED BOAT RACE | |
|---|---|
| Ground Space Requirements | 500 × 60 Ft. |
| Launch Chute Length | 100 Ft. |
| Brakes - linear induction motor control | |
| Propulsion - 160 linear induction motors in each propulsion group for launch, hydroplaning and coasting speeds | |
| Positioning - guide wheels, centering wheels under the boat | |
| Guide Channel Length | 300 Ft. |
| Boat Speed (Hydroplaning) | 40 M.P.H. |
| Number of Guide Channels | 2 |
| Boat Length | 25 Ft. |
| Boat Width | 8 Ft. |
| Passengers per Boat | 24 to 26 |
| Acceleration - 1.5 G during launch | |
| Peak Electrical Power - 1,000 amperes per phase at 480 VAC, 3-phase, 60 Hz | |

TABLE 2

| PASSENGER BOAT CLIMB | |
|---|---|
| Ground Space Requirements | 400 x 60 Ft. |
| Dock Lengths | 50 Ft. |
| Positioning - guide wheels, centering wheels under the boat | |
| Guide Channel Length | 200 Ft. |
| Launch Chute Length | 100 Ft. |
| Launch Chute Elevation | 70 Ft. |
| Propulsion - 160 linear induction motors in each propulsion group for hydroplaning and coasting speeds; 200 linear induction motors in each propulsion group for climb and launch acceleration | |
| Boat Speed (Hydroplaning) | 40 M.P.H. |
| Number of Guide Channels | 2 |
| Boat Length | 25 Ft. |
| Boat Width | 8 Ft. |
| Passengers Per Boat | 24 to 26 |
| Acceleration - 1.5 G during launch | |
| Peak Electrical Power - 2,000 amperes per phase at 480 VAC, 3-phase, 60 Hz | |

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

What is claimed is:

1. An amusement boat ride for transporting passengers through a watercourse comprising, in combination:

a guide channel structure submerged in the watercourse;

a passenger boat movably coupled to the guide channel structure for travel through the watercourse; and, linear induction motor drive means including a stator component and a reaction component coupled to the passenger boat and to the guide channel structure for propelling the passenger boat through the watercourse.

2. An amusement boat ride as set forth in claim 1, wherein the submerged guide channel structure includes one or more guide rails extending in a closed loop.

3. An amusement boat ride as set forth in claim 1, wherein the guide channel structure includes one or more guide rails arranged in a "Figure-Eight" closed loop.

4. An amusement boat ride as set forth in claim 1, wherein the guide channel structure comprises one or more guide rails arranged in an hour-glass pattern.

5. An amusement boat ride as set forth in claim 1, wherein the guide channel structure comprises one or more guide rails arranged in a curved pattern.

6. An amusement boat ride as set forth in claim 1, wherein the guide channel structure includes dual guide tracks, each guide track including one or more rails arranged in a "Figure-Eight" pattern and extending generally in alignment with each other.

7. An amusement boat ride as set forth in claim 1, wherein the guide channel structure comprises a ramp portion elevated above the watercourse for simulating travel over a jump ramp.

8. An amusement boat ride as set forth in claim 1, wherein the guide channel structure comprises an underground tunnel that extends beneath the floor of the watercourse.

9. An amusement boat ride as set forth in claim 1, wherein the guide channel structure includes one or more guide rails extending in a closed loop, serpentine pattern.

10. An amusement boat ride as set forth in claim 1, wherein the submerged guide channel structure includes one or more guide rails extending in a closed loop, and including multiple linear induction motors mounted on the guide rails for propelling one or more passenger boats through the watercourse.

11. An amusement boat ride as set forth in claim 1, including:

a safety release system coupled to the linear induction motor drive means for controlling movement of the passenger boat.

12. An amusement boat ride as set forth in claim 1, including:

a first launch station disposed adjacent the guide channel structure;

a second launch station disposed adjacent the guide channel structure at a location remote from the first launch station;

a first turntable disposed at the first launch station;

a second turntable disposed at the second launch station;

whereby the passenger boat can be rotated and launched from and returned to the first and second launch stations.

13. An amusement boat ride for carrying passengers across a watercourse comprising, in combination:

a submerged guide channel structure extending through the watercourse;

multiple linear induction motors attached to the guide channel structure, each linear induction motor including a linear stator and a longitudinal flux slot;

a carriage assembly including a passenger boat movably coupled to the guide channel structure for travel through the watercourse; and, a magnetically responsive reaction plate attached to the carriage assembly and projecting radially from the carriage assembly for linear travel through the flux slots of the linear induction motors.

14. An amusement boat ride as set forth in claim 13, wherein the guide channel structure comprises first and second laterally spaced guide rails, further including:

at least first and second centering wheels mounted beneath the passenger boat for rolling engagement against the first and second guide rails, respectively.

15. An amusement boat ride for transporting passengers across a watercourse comprising, in combination:

a first launch station disposed adjacent one end of the watercourse;

a second launch station disposed adjacent an opposite end of the watercourse;

a guide structure submerged in the watercourse and extending from the first launch station to the second launch station;

a passenger boat including an undercarriage assembly movably coupled to the guide structure for forward and return travel through the watercourse;

linear induction motor drive means including multiple linear induction stators mounted on the guide structure, each stator having a longitudinal flux slot disposed in alignment with the direction of travel; and, a magnetically responsive reaction plate coupled to the passenger boat, the reaction plate projecting beneath the passenger boat for longitudinal travel through the flux slot and for electromagnetic coupling with magnetic flux produced by the induction stator as the passenger boat moves along the guide structure.

16. An amusement boat ride apparatus comprising, in combination:

a pair of first launch stations disposed adjacent one end of a watercourse;

a pair of second launch stations disposed adjacent an opposite end of the watercourse;

a pair of parallel guide structures submerged in the watercourse and extending from the first launch stations to the second launch stations;

a pair of passenger boats movably coupled to the guide structures for forward and return travel through the watercourse;

power drive means disposed adjacent the parallel guide structures for propelling the passenger boats across the watercourse, the power drive means including multiple linear induction motors mounted on the guide structure, each linear induction motor including a linear stator and a linear flux slot extending in alignment with the direction of travel; and, a magnetically responsive reaction plate coupled to each passenger boat and projecting therefrom for travel through the linear flux slots.

17. An amusement boat ride for transporting passengers across a watercourse comprising, in combination:

a guide structure submerged in the watercourse;

a passenger boat movably coupled to the guide structure for travel across the watercourse; and, power drive means including a linear induction stator mounted on the guide structure and a reaction plate coupled to the passenger boat for propelling the passenger boat across the watercourse.

* * * * *